United States Patent [19]

Margaria

[11] Patent Number: 4,984,701

[45] Date of Patent: Jan. 15, 1991

[54] TAMPER-EVIDENT CLOSURE

[75] Inventor: Mario Margaria, Asti, Italy

[73] Assignee: Alplast S.p.A., Tigliole D'Asti, Italy

[21] Appl. No.: 336,355

[22] PCT Filed: Sep. 22, 1987

[86] PCT No.: PCT/EP87/00539

§ 371 Date: Mar. 22, 1989

§ 102(e) Date: Mar. 22, 1989

[87] PCT Pub. No.: WO88/02340

PCT Pub. Date: Apr. 7, 1988

[30] Foreign Application Priority Data

Sep. 24, 1986 [IT] Italy ..... 53868/86[U]
Sep. 16, 1987 [IT] Italy ..... 53650/87[U]

[51] Int. Cl.[5] ..... B65D 41/34
[52] U.S. Cl. ..... 215/256; 215/258
[58] Field of Search ..... 215/252, 253, 254, 256, 215/258

[56] References Cited

U.S. PATENT DOCUMENTS

| | | | |
|---|---|---|---|
| 3,955,716 | 5/1976 | Goncalves | 215/256 X |
| 4,109,816 | 8/1978 | Faulstich | 215/256 |
| 4,122,965 | 10/1978 | Roy | 215/DIG. 1 |
| 4,127,209 | 11/1978 | Ritzenhoff | 215/256 X |
| 4,128,185 | 12/1978 | Wszolek | 215/349 |
| 4,129,226 | 12/1978 | Percival | 215/253 X |
| 4,342,400 | 8/1982 | Llera | 215/156 |
| 4,417,666 | 11/1983 | Roberts | 215/258 X |
| 4,449,639 | 5/1984 | Davis | 215/258 X |
| 4,476,987 | 12/1984 | Nolan | 215/270 |
| 4,527,705 | 7/1985 | Prades | 215/252 |
| 4,531,650 | 7/1985 | Friendship | 215/256 |

FOREIGN PATENT DOCUMENTS

| | | | |
|---|---|---|---|
| 528526 | 5/1954 | Belgium | 215/256 |
| 0120644 | 10/1984 | European Pat. Off. | 215/252 |
| 528769 | 11/1921 | France | 215/256 |
| 1412866 | 10/1965 | France | 215/254 |
| 977312 | 4/1960 | United Kingdom | 215/254 |
| 1444302 | 7/1976 | United Kingdom | 215/252 |

*Primary Examiner*—Stephen Marcus
*Attorney, Agent, or Firm*—Sughrue, Mion, Zinn, Macpeak & Seas

[57] ABSTRACT

The mouth of a rigid container, particularly of glass, having a screw closure device and usable for food products intended to be subjected to heat treatment in the container to preserve them, is provided with an annular rib of triangular profile below the threading. Screwed onto the mouth is a rigid plastic capsule having a plastic mastic sealing coating on the inner surface of its top and incorporating in its peripheral skirt a tearing band for opening. The lower part of the cylindrical skirt of the capsule constitutes a security seal and has an inner annular engagement rib which snap-engages beneath the annular rib of the mouth.

4 Claims, 3 Drawing Sheets

TAMPER-EVIDENT CLOSURE

Figure 1:
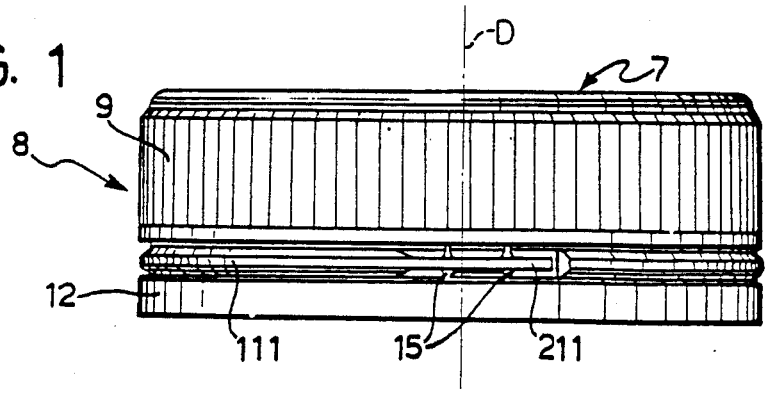

The present invention relates to a tamper-evident closure for use in connection with a rigid container including a threaded neck portion and an annular rib below said threaded neck portion, said closure comprising a one piece plastic capsule including a flat top wall and a cylindrical skirt, the inner surface of said flat top wall including sealing means cooperating with the upper end of the container neck portion and said cylindrical skirt including an internally threaded upper portion, an intermediate portion comprised between two circumferential weakening zones, said intermediate portion forming a tearable opening band having a gripping portion, and a lower portion including an inwardly projecting annular engagement rib which snap engages below said annular rib of the container neck as a result of the first screwing on of the capsule.

A tamper-evident closure of the above mentioned type is known from FR-A-92382. Said document describes a capsule made of polyethylene; in the capsule illustrated in FIG. 7 of said document the entire tearing band extends outwardly of the skirt of the capsule relative to the two weakened zones which connect the tearing band to the skirt of the capsule.

The capsule disclosed in FR-A-92382 could not be used as closure for rigid containers, generally of glass, which are used in the food industry for containing products which are subjected, after the container has been filled and closed, to a heat treatment at a relatively high temperature to pasteurize the product or create a vacuum within the container, in order to ensure preservation of the product in time.

In fact, in order to ensure the necessary resistance to the heat treatment, the capsule should be made of a plastic material having a hardness much greater than that of polyethylene; the Applicant has found that if a very rigid plastics material, such as polypropylene filled with mineral fibre having a hardness greater than 75 Shore D, is used for the manufacture of a capsule as disclosed in FR-A-92382, the tearing band is broken prior to the completion of the tearing phase which causes the separation of the tearing band and lower skirt portion from the upper threaded skirt portion of the capsule.

This breakage is due to the fact that, as the cross-section of the tearing band is situated entirely outwardly of the capsule relative to the weakened zones connecting it to the capsule, when the operation of tearing of the band is initiated, the shearing stress produced in the weakened zones occurs adjacent the part of the cross-section of the tearing band which is subject of the greatest tensile stress.

For this reason, breakage due to shearing in the weakened zones simultaneously initiates breakage of the adjacent part of the band which is subject to tensile stress, which may lead to breakage of the band itself before its removal from the capsule has been completed.

The object of the present invention is to enable plastics materials with a hardness greater than 75 Shore D to be used for the manufacture of tamper-evident capsules of the above-mentioned type, without the risk of breakage of the tearing band during the tearing phase.

According to the present invention, in order to achieve this object, a tamper-evident capsule of the above-mentioned type is characterised in that the capsule is made of a synthetic resin having a hardness greater than 75 Shore D and the tearable opening band extends, at least in part, inwardly of the cylindrical skirt of the capsule relative to the two weakened zones which connect said band to the skirt.

Figure 2:
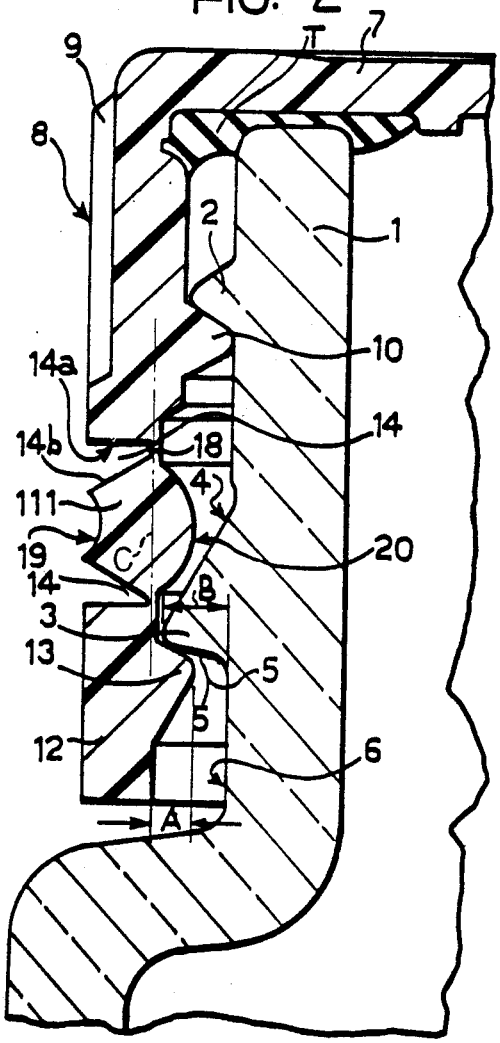
Figure 3:
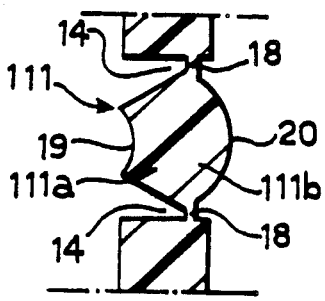
Figure 4:
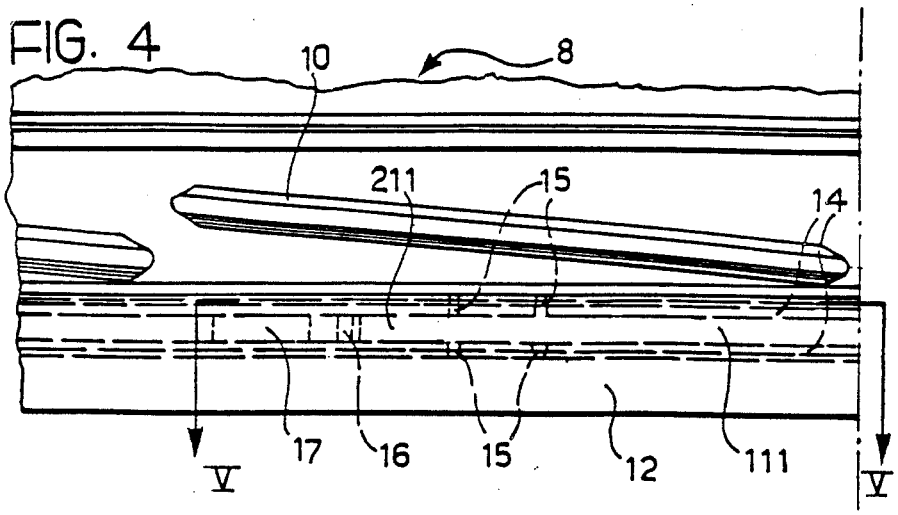
Figure 6:
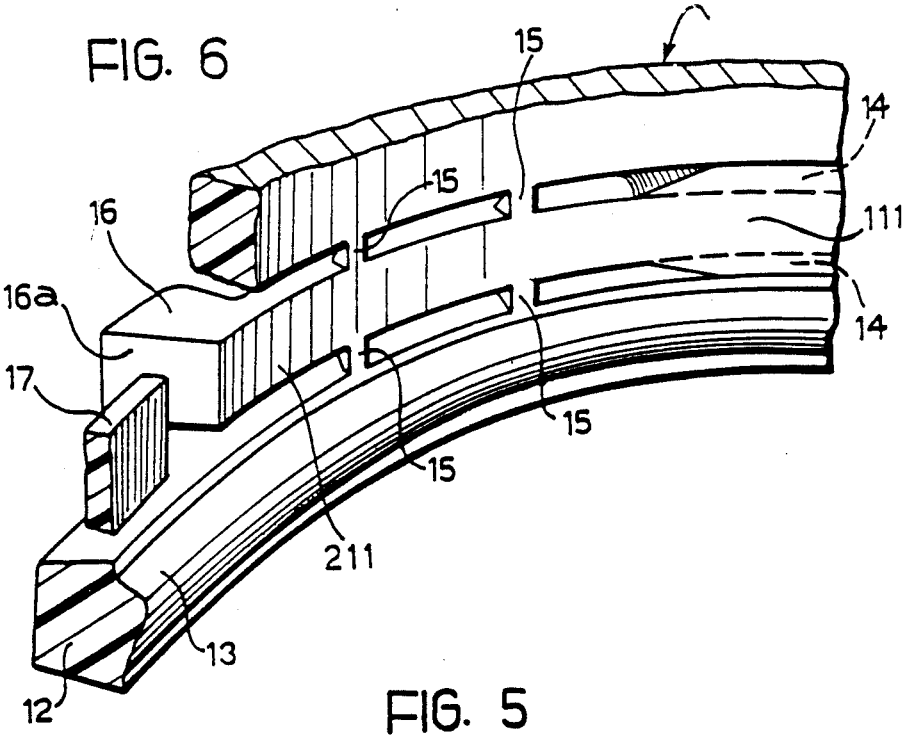
Figure 5:
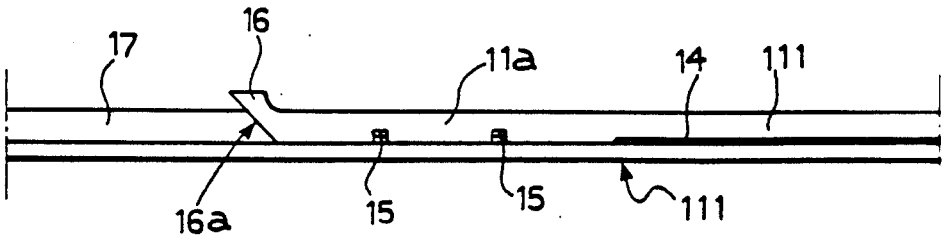
Figure 7:
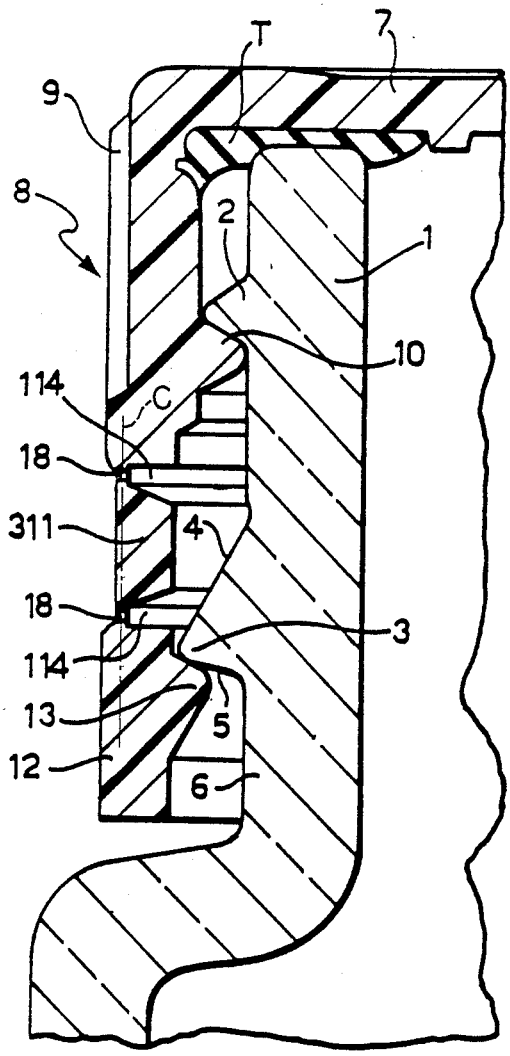

The invention will now be described with reference to the appended drawings, in which:

FIG. 1 is a front elevational view of a capsule,

FIG. 2 is a partial axial section, in an enlarged scale, of the capsule shown in FIG. 1, screwed on the neck of a container, FIG. 3 is a detail of FIG. 2 on an enlarged scale, FIG. 4 is a partial view of the interior of the capsule developed in a plane, FIG. 5 is a section taken on the line V—V of FIG. 4, FIG. 6 is a perspective view from the interior of a portion of the peripheral wall of the capsule, and FIG. 7 is a variant of FIG. 2.

As illustrated in FIG. 2, the neck of a rigid container, generally of glass, such as, for example a small jar or bottle intended to contain a food product which must be subjected to a heat treatment at a relatively high temperature, for example of the order of 80° C. to preserve it after it has been introduced into the container, as indicated 1. The outer surface of the neck 1 has threading 2 with one or more threads, preferably threading with four threads of the type used in known glass bottles with "twist-off" metal closures.

Furthermore, at the base of the threading, the neck 1 has an annular rib 3 with a triangular profile comprising a frusto-conical upper surface 4 which diverges downwardly of the container and a substantially radial lower surface 5 which connects the larger base of the frustum to a lower cylindrical portion 6 of the neck 1.

The frusto-conical surface 4 has an inclination of about 30° to the axis of the neck, while the lower surface 5 is slightly inclined, for example at about 8°, to a plane perpendicular to this axis.

Screwed onto the neck 1 is a capsule moulded from a plastics material, with a hardness greater than 75 Shore D, such as a polypropylene resin filled with mineral fibres which can withstand the working temperatures used to create a vacuum in the container or pasteurize the food product contained therein, in use of the container.

As shown in FIGS. 1 and 2, the capsule includes a flat top wall 7 and a cylindrical skirt 8 having external longitudinal ribs 9 and an internal thread 10.

The top wall 7 of the capsule has an internal annular seat in which is lodged an annular plastic mastic sealing T, which is cast and subsequently polymerized by heating in the capsule, for forming the seal between the capsule and the edge of the neck 1.

Adjacent the flat top wall 7, the capsule has a thread 10 for screwing onto the threading 2 of the neck 1; a tearable opening band 111 is incorporated in an intermediate part of the skirt 8 of the capsule.

The lower part of the skirt 8 forms a security seal 12 having an inner surface with an annular engagement rib 13 which snap-engages beneath the annular rib 3 of the neck 1 as a result of the first screwing on of the capsule.

As illustrated in FIG. 2, the engagement rib 13 projects from the inner surface of the wall 8 by a distance A equal to about half the projection B of the annular rib 3 from the lower cylindrical portion 6.

By virtue of this characteristic, when the lower part 12 of the skirt 8 is separated from the remaining part as a result of the tearing of the band 111, the ring obtained can be easily removed from the mouth 1 of the container by its being disposed in an oblique position so that it can pass over the annular rib 3.

The intermediate part of the skirt 8 of the capsule has, in its outer surface, two deep annular weakening V-shaped grooves 14 which are axially spaced from each other and define the greater part of the circumferential development of the tearing band 111.

The remaining part of the tearing band, indicated 211, has a length of the order of 2–3 cm and constitutes the gripping portion for the manual tearing of the band 111.

As shown in FIGS. 4, 5 and 6 the gripping portion 211 is connected to the skirt 8 by two pairs of trapezoidal bridges 15 having their larger bases on the band so that, when the bridges 15 are broken as a result of the raising of the gripping portion 11*a*, they remain attached to the portion 11*a* and are thus removed from the capsule together with the tearing band 111.

The gripping portion 211 of the tearing band 111 has an enlarged end 16 provided with a 45° bevel 16*a* for facilitating its detachment by raising from the adjacent, extremely thin end portion 17 of the band 111.

The two annular grooves 14 give rise to two weakened zones 18 whose thickness is much less than that of the cylindrical skirt of the capsule and which connect the tearing band 111 to the skirt 8.

As can be seen in FIG. 2, in a cross-section the two weakened zones 18 are aligned on a vertical line C which is parallel to the longitudinal axis of the cylindrical skirt, indicated as D in FIG. 1.

In the example illustrated in FIG. 2, the weakened zones 18 are continuous; in known manner, however, they could also be interrupted, that is, they could consist of a plurality of spaced bridges separated from each other by apertures formed in the bottoms of the grooves 14.

Each annular groove 14 has a substantially triangular profile with an outer part 14*a* substantially perpendicular to the central axis of the capsule and an inclined inner part 14*b*.

The two inclined walls 14*b* converge outwardly of the capsule so that, as illustrated in FIG. 3, the tearing band 111 has a part 111*a* which is substantially trapezoidal in cross-section and is situated outwardly of the two weakened zones 18. The smaller base of the trapezoidal part 111*a* of the tearing band 111 has a recess 19.

Furthermore, the tearing band 111 has a part 111*b* which projects inwardly of the capsule relative to the two weakened zones 18 and whose cross-section is preferably defined by an arch-shaped line 20, so that the part 111*b* constitutes a thickening of the tearing band 111 facing towards the inside of the capsule.

Due to the presence of the inner thickening 111*b*, the zone of the cross-section of the tearing band 11 which is adjacent the two weakened zones 18 is situated near the neutral axis of the cross-section of the tearing band 111.

As a result, when the band 111 is torn from the capsule using the gripping zone 211, the shearing stress which is produced in the two weakened zones 18 occurs adjacent a part of the cross-section of the tearing band 111 which is near the neutral axis of the cross-section that is, adjacent a zone in which the stresses are practically negligible.

Thus, there is avoided the risk that, during the operation of tearing open of the capsule, the breakage due to the shearing stress in the two weakened zones 18 may initiate breakage of the part of the tearing band 111 which is adjacent these weakened zones 18, given the high rigidity of the material which constitutes the tearing band.

The purpose of the recess 19 formed in the smaller outwardly-facing base of the trapezoidal part 11*a* of the cross-section of the tearing band 11 is to avoid breakage, even when the thickening 111*a* is not very pronounced.

In the variant illustrated in FIG. 7, the tearing band, indicated 311, is defined by two grooves 114 formed in the inner surface of the skirt 8 of the capsule and is trapezoidal in shape, with its larger base in correspondence with the two weakened zones 18.

Thus, a substantial portion of the cross-section of the tearing strip 311 is situated inwardly of the capsule relative to the vertical line C which joins two weakened zones 18.

In this case, the shearing stress produced in the weakened zones 18 during tearing of the band 311 occurs adjacent the part of the cross-section of the tearing band which is subjected to the greatest compression stress, and this prevents the breakage of the weakened zones 18 from causing breakage of the tearing band 311.

I claim:

1. A tamper-evident closure for use in connection with a rigid container including a threaded neck portion and an annular rib below said threaded neck portion, said closure comprising a one piece plastic capsule including a flat top wall and a cylindrical skirt having a longitudinal axis, the inner surface of said flat top wall including sealing means cooperating with the upper end of the container neck portion and said cylindrical skirt including an internally threaded upper portion, an intermediate portion comprised between two circumferential weakening zones which, in a cross-section, are aligned on a vertical line which is parallel to said longitudinal axis of the cylindrical skirt, said intermediate portion forming a tearable opening band having a gripping portion, and a lower portion including an inwardly projecting annular engagement rib which snap engages below said annular rib of the container neck as a result of the first screwing on of the capsule, characterized in that the capsule is made of a synthetic resin having a hardness greater than 75 Shore D and the tearable opening band extends, at least in part, inwardly of the cylindrical skirt of the capsule relative to the vertical line which joins the two weakened zones which connect said band to the skirt.

2. A tamper-evident closure according to claim 1, characterized in that the cross-section of the tearing band of the capsule has an outer part which is substantially trapezoidal in shape and is defined by two grooves provided in the outer surface of the skirt of the capsule and forming two weakened zones, said outer trapezoidal part having its larger base in correspondence with the bottoms of the two grooves and being provided with a concave recess in correspondence with the smaller base of the trapezium facing the outside of the capsule, the tearing band also having an inner part which extends inwardly of the skirt of the capsule from the larger base of the trapezoidal outer part; the cross-section of said inner part of the tearing band being defined by a line which is curved towards the inside of the capsule, whereby the zone of the cross-section of the tearing band which is adjacent the two weakened zones is situated near the neutral axis of the cross-section of the tearing band.

3. A tamper-evident capsule according to claim 1, characterized in that a substantial portion of the cross-section of the tearing band is situated inwardly of the skirt of the capsule relative to said vertical line which joins the two weakened zones which are defined by two grooves formed in the inner surface of the skirt of the capsule.

4. A tamper-evident capsule according to claim 3, characterized in that the tearing band is substantially trapezoidal in cross-section, having its larger base situated in correspondence with the weakened zones and its smaller base facing the inside of the capsule.

* * * * *